US006155806A

United States Patent [19]

Andel

[11] Patent Number: 6,155,806

[45] Date of Patent: Dec. 5, 2000

[54] DUAL ACTING PISTON PUMP HAVING REDUCED BACK FLOW BETWEEN STROKES

[75] Inventor: David F. Andel, Lawrenceville, Ga.

[73] Assignee: Nordson Corporation, Westlake, Ohio

[21] Appl. No.: 09/212,457

[22] Filed: Dec. 16, 1998

[51] Int. Cl.[7] ..... F04B 53/00

[52] U.S. Cl. ..... 417/523; 417/403

[58] Field of Search ..... 137/116, 119; 60/560; 123/449; 184/24; 417/523, 393, 403, 266, 425, 417, 53, 444, 418, 259, 554

[56] References Cited

U.S. PATENT DOCUMENTS

| | | | |
|---|---|---|---|
| 3,160,105 | 12/1964 | Sherman et al. | 103/48 |
| 3,692,038 | 9/1972 | Hansen et al. | 137/116 |
| 3,922,116 | 11/1975 | Pugh | 417/393 |
| 3,995,966 | 12/1976 | Blancha | 417/254 |
| 4,030,299 | 6/1977 | Reuschel et al. | 60/560 |
| 4,125,124 | 11/1978 | Kah | 137/119 |
| 4,397,614 | 8/1983 | Larner | 417/403 |
| 4,407,249 | 10/1983 | Eheim | 123/449 |
| 4,443,162 | 4/1984 | O'Connor | 417/425 |
| 4,548,552 | 10/1985 | Holm | 417/417 |
| 4,832,578 | 5/1989 | Putt | 417/266 |
| 5,067,882 | 11/1991 | DeVries et al. | 417/511 |
| 5,346,037 | 9/1994 | Flaig et al. | 184/24 |
| 5,494,410 | 2/1996 | Maler-Laxhuber et al. | 417/53 |
| 5,642,990 | 7/1997 | Short | 417/444 |
| 5,662,461 | 9/1997 | Ono | 417/418 |
| 5,676,529 | 10/1997 | Hermansen et al. | 417/259 |
| 5,988,997 | 11/1999 | Slegel | 417/554 |

OTHER PUBLICATIONS

Nordson Corporation, *SP Series Pumps*, two pages, 1993, 1998.

Nordson Corporation, *Series 3000, Hot Melt Adhesive Pumps*, two pages, 1989.

*Primary Examiner*—Philip H. Leung
*Assistant Examiner*—Leonid Fastovsky
*Attorney, Agent, or Firm*—Wood, Herron & Evans, L.L.P.

[57] ABSTRACT

A dual acting pump for dispensing pressurized liquids including a pump housing, a reciprocating pump shaft contained in a pumping chamber and at least one spring-biased check valve member. In the preferred embodiment, a spring-biased check valve member is connected to one end of the pump shaft for closing a flow passage in the pump shaft during movement in one direction and for opening the flow passage during movement in the opposite direction. Similar spring-biased check valves are connected to the pump inlet and pump outlet. The check valves comprise hollow balls and, in combination with the springs, this assures that liquid output from the pump is not reduced significantly when the pump shaft changes direction.

20 Claims, 6 Drawing Sheets

DUAL ACTING PISTON PUMP HAVING REDUCED BACK FLOW BETWEEN STROKES

FIELD OF THE INVENTION

The present invention generally relates to piston pumps and, more specifically, to dual acting piston pumps for dispensing liquids such as hot melt adhesive materials.

BACKGROUND OF THE INVENTION

Piston pumps generally have internal shafts that reciprocate back and forth to draw liquid into the pump and then force the liquid out of the pump. Dual acting piston pumps of this type dispense liquid in both directions of the reciprocating shaft movement. Examples of dual acting pumps are disclosed in U.S. Pat. Nos. 3,160,105; 3,995,966; and 5,067,882. Generally, these pumps include a pump body formed with a longitudinally extending passageway defining a pumping chamber divided into first and second pumping sections. The pumping chamber receives a portion of the pump shaft for reciprocating movement. The first section of the pumping chamber communicates with a discharge outlet formed in the pump body and the second section of the pumping chamber communicates with an inlet that receives a source of the liquid. The pump shaft carries a check valve and, in one direction of shaft movement, the check valve is moved to a closed position and material is forced out of the first section of the pumping chamber through the discharge outlet. At the same time, additional liquid is drawn in from the liquid source through the inlet into the second section of the pumping chamber. Reverse movement of the pump shaft into the second section of the pumping chamber opens the check valve associated with the shaft and forces liquid from the second section of the pumping chamber to the first section. This moves a corresponding amount of liquid through the discharge outlet.

The SP Series and Series 3000 pumps of Nordson Corporation, Westlake, Ohio, include pump shafts with attached check valves as generally described above and further include a check valve at the pump inlet. Each of these check valves comprise free-floating solid balls. The ball at the inlet closes the inlet while the pump shaft moves from the first section of the pumping chamber to the second section as described above. The ball carried by the pump shaft alternately moves against and away from a valve seat as the pump shaft reciprocates to selectively prevent and allow liquid flow from the second section to the first section.

Although existing piston pumps perform well in many applications, certain areas are still in need of improvement. One of these areas relates to the reduction in liquid output, measurable as flow rate and pressure, that occurs as the reciprocating pump shaft changes direction. In this regard, if liquid flows back toward the pump inlet as the shaft changes direction, this reduces flow rate and pressure at the outlet. These characteristics of typical dual acting piston pumps reduce liquid output from both the pump and any downstream dispensing device as the shaft changes direction. In hot melt adhesive dispensing operations, for example, many applications require uniform liquid discharge for purposes of obtaining an adequate adhesive bond. Reduced adhesive output from a pump can reduce adhesive bead widths or dot sizes to an extent that compromises bonding strength. Some applications further require the adhesive to be discharged laterally across a gap before reaching the substrate. In these applications, a reduced flow rate or pressure can also prevent the adhesive from hitting the substrate at the correct location or from hitting the substrate altogether.

To address various problems such as those mentioned above, it would be desirable to provide a dual acting pump that minimizes irregular liquid discharge due to the change in direction of the pump shaft and, more specifically, due to back flow of liquid in the pump.

SUMMARY OF THE INVENTION

The present invention provides a pump for dispensing pressurized liquids generally including a pump housing having a liquid inlet passage and a liquid outlet passage. A pumping chamber disposed in the housing includes first and second sections, with the first section communicating with the liquid inlet passage and the second section communicating with the liquid outlet passage. The pumping chamber receives a reciprocating pump shaft having first and second ends. The second end of the pump shaft includes a flow passage that alternately moves liquid from the first and second sections of the chamber to the liquid outlet passage during reciprocating movement of the pump shaft. In accordance with one aspect of the invention, a spring-biased check valve member is operatively connected to the second end of the pump shaft and closes the flow passage during movement in the first direction. This spring-biased check valve opens the flow passage during movement in the second direction. The spring bias ensures that the ball quickly closes the flow passage as the pump shaft changes from the second direction of movement to the first direction. This significantly reduces back flow of liquid in the pump as the shaft changes direction. In accordance with a more specific aspect of the invention, the spring-biased check valve member is a hollow ball biased by a compression spring. Due to its hollow construction, the ball moves more quickly toward the closed position as the pump shaft changes direction.

As an additional aspect of the invention, a spring-biased check valve member is connected with the liquid inlet passage and quickly closes the liquid inlet passage as the pump shaft changes from the first direction of movement to the second direction of movement. This spring-biased check valve member is preferably a hollow ball biased by a compression spring for the reasons discussed above.

As another aspect of the invention, a spring-biased check valve member is connected with the liquid outlet passage and operates to quickly close and then reopen the liquid outlet passage during each change in the direction of shaft movement. As with the other spring-loaded check valves, this prevents back flow into the pump and assures that adverse losses of flow rate and pressure do not occur. This spring-biased check valve member is also preferably a hollow ball biased by a compression spring for the reasons discussed above.

The invention further contemplates methods of dispensing pressurized liquids in manners that provide adequate liquid output from the pump during changes in direction of the reciprocating pump shaft. These methods can generally involve dispensing liquids, such as hot melt adhesive materials, using a dual acting pump having one or more features as generally described above and illustrated in detail below.

Other objects, advantages and features of the invention will become more readily apparent to those of ordinary skill in the art upon further review of the following detailed description taken in conjunction with the accompanying drawings.

DETAILED DESCRIPTION OF THE PREFERRED EMBODIMENT

Figure 1:
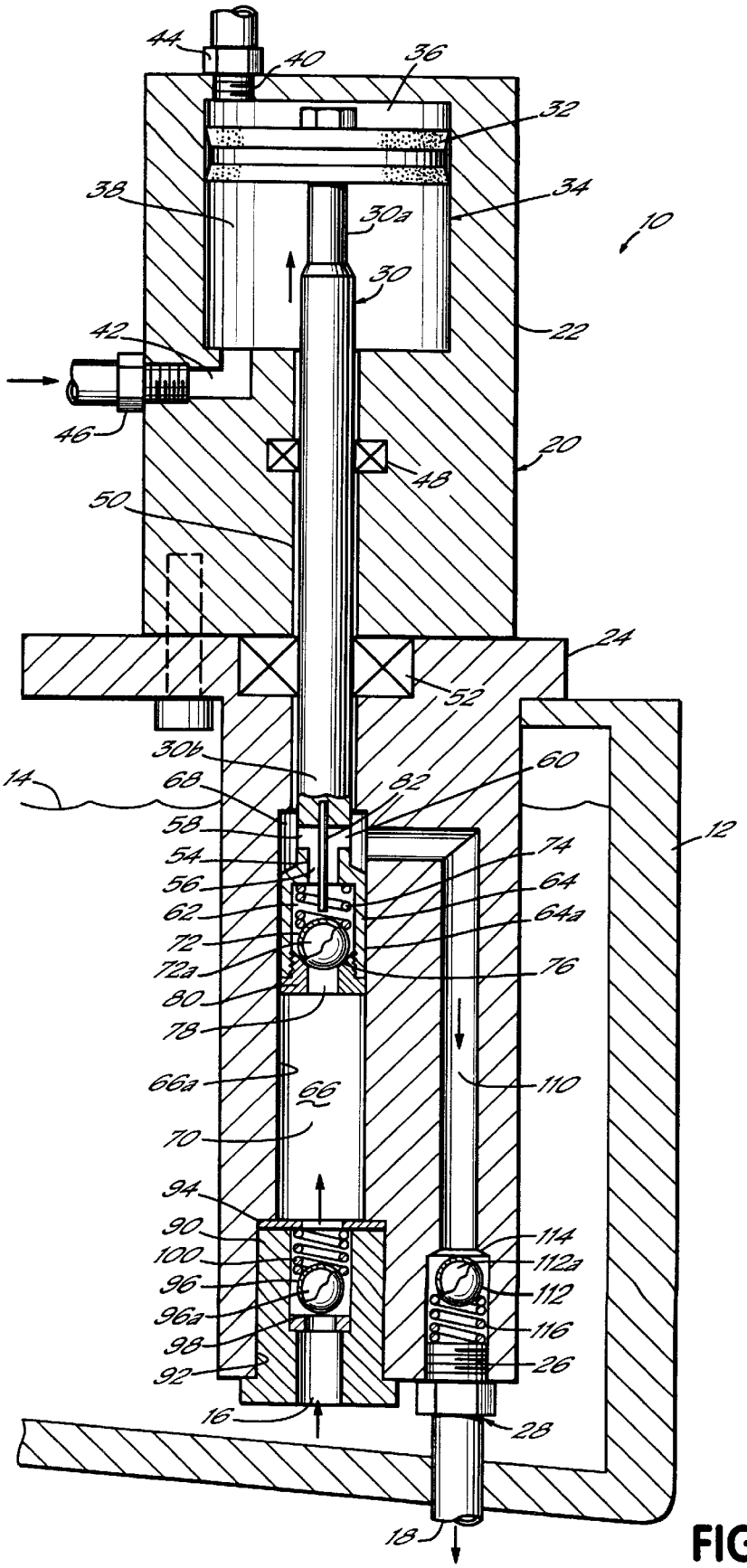
FIG. 1 is a longitudinal cross section of a dual acting pump of the invention showing the pump in a partially illustrated liquid reservoir and the pump shaft positioned near the end of an upward stroke.
Figure 2:
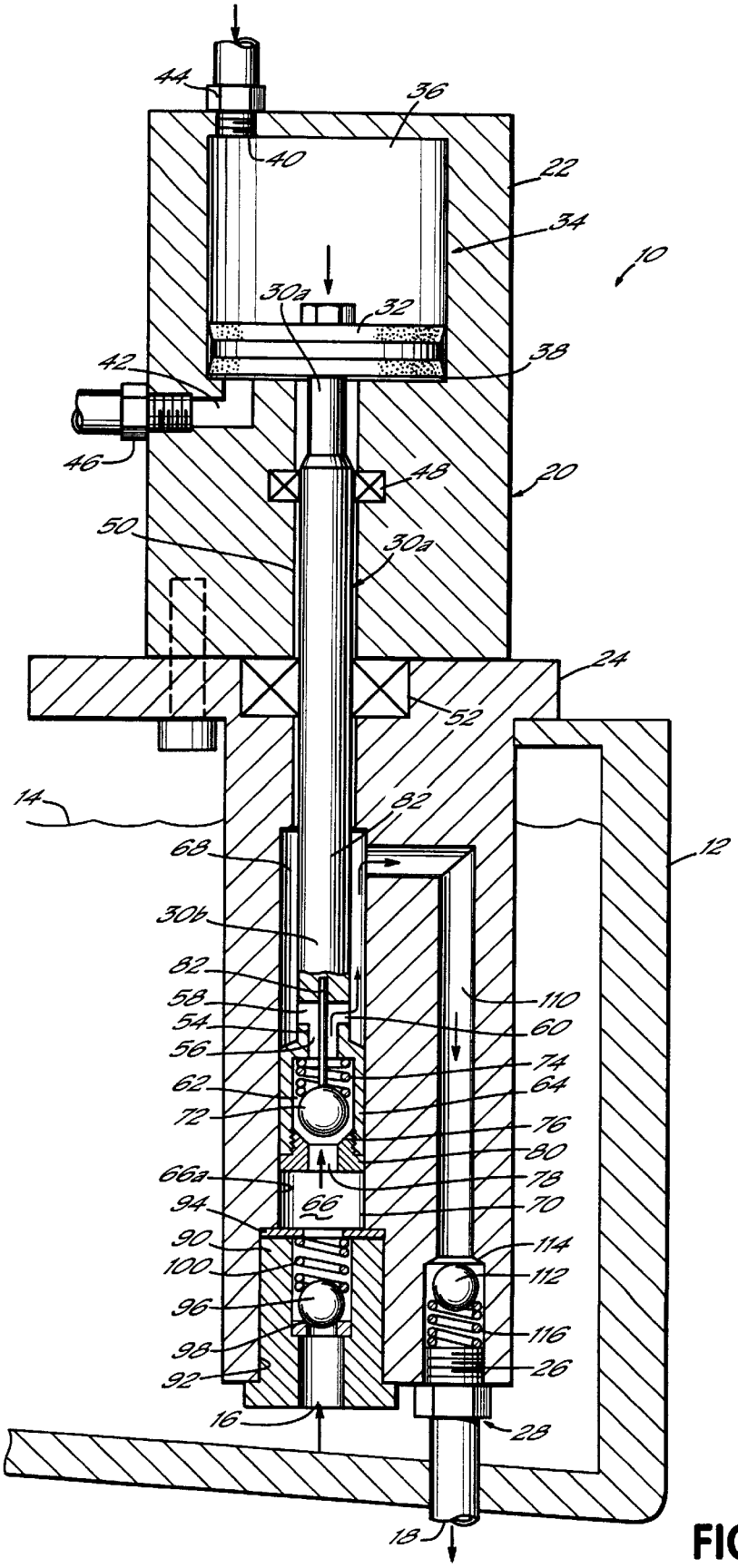
FIG. 2 is a longitudinal cross section of the pump similar to FIG. 1, but illustrating the pump shaft near the end of a downward stroke.

Referring to FIGS. 1 and 2, the preferred configuration of a dual acting pump 10 is illustrated in accordance with the principles of this invention. It should be noted that pump 10 is only one of many potential configurations that can benefit from the invention. Pump 10 may be disposed within a reservoir 12 containing liquid 14. Although many applications may benefit from the invention, pump 10 is particularly suited to dispense liquefied hot melt adhesive material from reservoir 12. Generally, pump 10 moves liquid 14 from an inlet 16 of pump 10 through an outlet 18 of reservoir 12. Pump 10 more specifically comprises a housing 20 having an upper section 22 and a lower section 24. Lower section 24 includes a liquid outlet 26 connected with outlet 18 of reservoir 12 by a suitable fluid fitting 28.

A pump shaft 30 having a first end 30*a* and a second end 30*b* is mounted for reciprocating movement within upper and lower sections 22, 24 of housing 20. First end 30*a* of pump shaft 30 carries an air-operated piston 32 mounted for reciprocating movement within a piston cylinder 34 formed within upper housing section 22. Piston 32 separates upper and lower portions 36, 38 of piston cylinder 34. Upper portion 36 of cylinder 34 communicates with a port 40 and, in a like manner, lower portion 38 of cylinder 34 communicates with a port 42. Suitable fittings 44, 46 connect with respective ports 40, 42 and ports 40, 42 may be connected in a typical manner to appropriate valving and pressurized air to reciprocate piston 32 and shaft 30 in opposite directions.

A seal 48 prevents pressurized air from leaking out of cylinder 34 into a bore 50 that carries pump shaft 30. A second seal 52, mounted within lower housing section 24, prevents pressurized liquid from leaking out of housing section 24. Pump shaft 30 includes a flow passage 54 generally contained in second end 30*b*. Although flow passage 54 may take many alternative forms, passage 54 preferably includes an axially extending section 56 and radially extending sections 58, 60. An additional section 62 of flow passage 54 may be contained in an increased diameter portion 64 of pump shaft 30 at second end 30*b*. An outer surface 64*a* of shaft portion 64 slides within a pumping chamber 66 with a close fit to chamber wall 66*a*. As will be described further below, shaft portion 64 reciprocates between a first section 68 and a second section 70 of pumping chamber 66. Flow passage portion 62 contains a ball 72 having a interior 72*a*. Ball 72 is biased by a compression spring 74 against a valve seat 76 to close an inlet 78 of passage 54. Spring 74 preferably is formed from stainless steel wire having a wire diameter of 0.026", an outer diameter of 0.360" and a free length of 0.620". Spring 74 has 4.74 total coils and a spring rate of 8.2 lb/in. Valve seat 76 is preferably disposed on a removable seat member 80 threaded into flow passage portion 62. A pin 82 is pressfit into pump shaft 30 and limits the movement of ball 72 away from valve seat 76. As will be understood from the description to follow, this ensures that liquid can continuously flow past ball 72, through spring 74 and into flow passage portion 56 when ball 72 lifts off of valve seat 76.

Another check valve 90 is mounted within a bore 92 communicating with pumping chamber 66. A washer 94 may separate check valve 90 from pumping chamber 66. A ball 96 having a hollow interior 96*a* is normally biased against a valve seat 98 by a compression spring 100. Spring 100 is similar to spring 74, except that it is formed from 0.038" stainless steel wire and has an outer diameter of 0.475"–0.505", a free length of 0.30", and a spring rate of 12 lb/in. Valve seat 98 may be an integral portion of check valve 90 or may be a separate member as shown. Compression spring 100 is disposed between washer 94 and ball 96 and allows ball 96 to raise off of valve seat 98 during the upward stroke of shaft 30 as shown in FIG. 1.

A liquid outlet passage 110 extends from first section 68 of pumping chamber 66 generally to outlet 26. Another spring-biased check valve in the preferred form of a ball 112 having a hollow interior 112*a* is normally biased against a valve seat 114 by a compression spring 116. Ball 112 prevents back flow of liquid into outlet passage 110 during each change in direction of pump shaft 30. As an alternative to the various check valve configurations detailed herein, other check valves may be utilized.

In operation, pump shaft 30 reciprocates at a rate which may be about 30–60 strokes/minute when dispensing many hot melt adhesives. Pump 10 will continuously pump liquid from inlet 16 through outlet 18 with reduced liquid back flow and increased liquid output during each directional change of shaft 30. Specifically, pump shaft 30 moves upward upon the introduction of pressurized air into cylinder section 38 and simultaneous exhaust of air from cylinder section 36. During this upward stroke, as shown in FIG. 1, ball 96 will raise from seat 98 and liquid 14 will flow through inlet 16 into pumping chamber section 70. During this same upward stroke, ball 72 connected with shaft 30 will be forced onto seat 76 by spring 74. Thus, liquid in pumping chamber section 68 will be forced into liquid outlet passage 110 by portion 64 of pump shaft 30. This liquid will travel through outlet passage 110 and push ball 112 off of valve seat 114 against the bias of spring 116. The liquid will then exit through outlet 18.

During the downward stroke shown in FIG. 2, ball 96 engages valve seat 98 and balls 72 and 112 are displaced from their respective valve seats 76, 114. During the downward stroke, liquid will move from pumping chamber section 70 through inlet 78 and past ball 72 in shaft 30. The liquid will then travel through spring 74 and flow passage portions 56, 58 into pumping chamber section 68. This simultaneously forces liquid through liquid outlet passage 110. Liquid will exit past ball 112, just as described above with respect to the upward stroke.

In accordance with the invention, when shaft 30 changes direction from the upward stroke to the downward stroke, balls 96, 112 will quickly engage seats 98, 114. Likewise, when shaft 30 changes from the downward stroke to the upward stroke, balls 72, 112 will quickly engage valve seats 76, 114. After each of these momentary changes in direction, ball 112 will reopen to allow flow through outlet 18. During each of these changes in direction, liquid will not flow back within pump 10 to an extent that adversely affects the end use.

Figure 3:
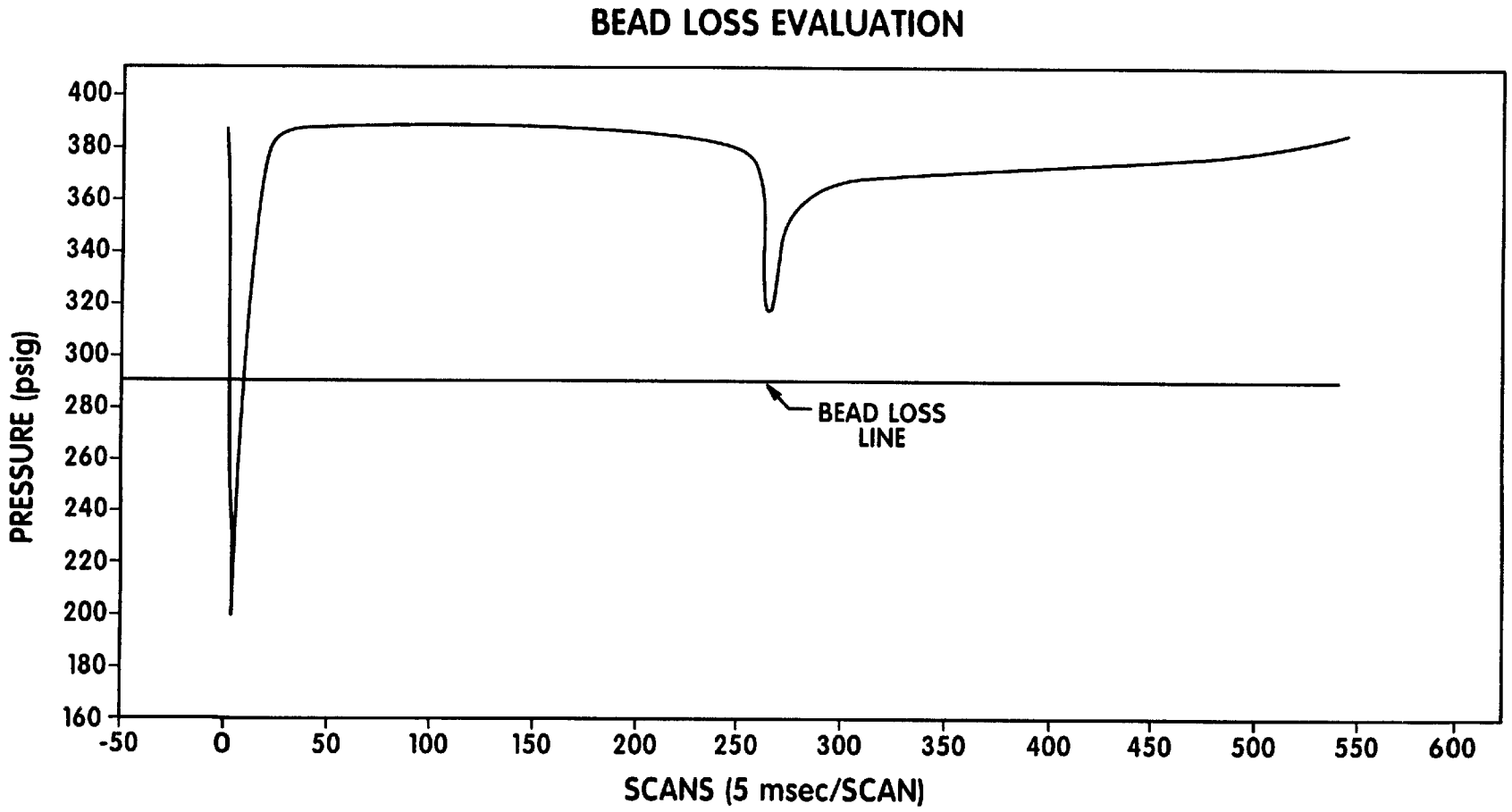
FIG. 3 is a graph illustrating adhesive bead loss in a dual acting pump of the prior art.
Figure 4:
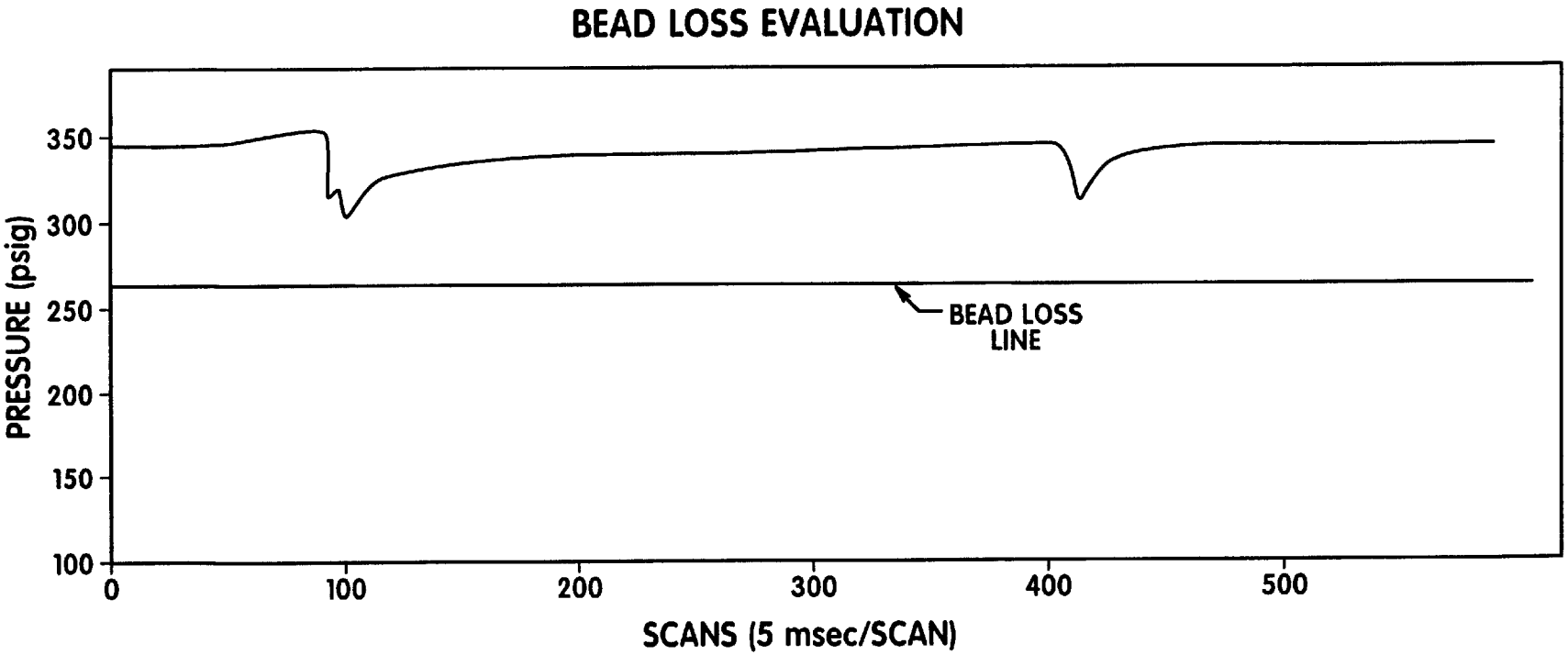
FIG. 4 is a graph similar to FIG. 3, but illustrating bead loss in a dual acting pump incorporating features of the present invention.

FIGS. 3 and 4 graphically illustrate the advantageous effects of the invention. The graph shown in FIG. 3 illustrates liquid pressure vs. scans (i.e., time) for a portion of a pump cycle including two changes in shaft direction. The pump comprised a Nordson SP Series pump as described in the background above having a check valve carried by the pump shaft and a check valve at the pump inlet. Each of these check valves comprised a solid, free-floating ball as described in the background. A bead loss line is drawn at the pressure which represents a decrease of more than 25%, from the set flow rate. The two significant dips in the pressure occur at the upshift and downshift of the pump shaft and, as shown in FIG. 3, a significant dip below the bead loss line occurs at one shift point. This pump was operated at approximately 21.5 cycles per minute and 30 psig inlet air pressure. In contrast, FIG. 4 illustrates a similar bead loss evaluation graph of a pump constructed in accordance with the invention. Specifically, compression springs and solid steel balls were used as check valves in the pump shaft and the pump inlet and a spring-loaded check valve was connected to the pump outlet. In comparison to the test illustrated in FIG. 3, the pump illustrated in FIG. 4 was operated with 28.2 psig air pressure and at 21.18 cycles per minute. As shown in the test results, two dips in the pressure are visible at the changes in direction of the pump shaft. However, neither of these dips were below the bead loss line. One alternative manner of defining bead loss in absolute terms involves measuring the time periods during which a laterally directed adhesive bead falls more than ⅛" below an intended target line on a substrate. The invention also successfully passes these tests.

Figure 5:
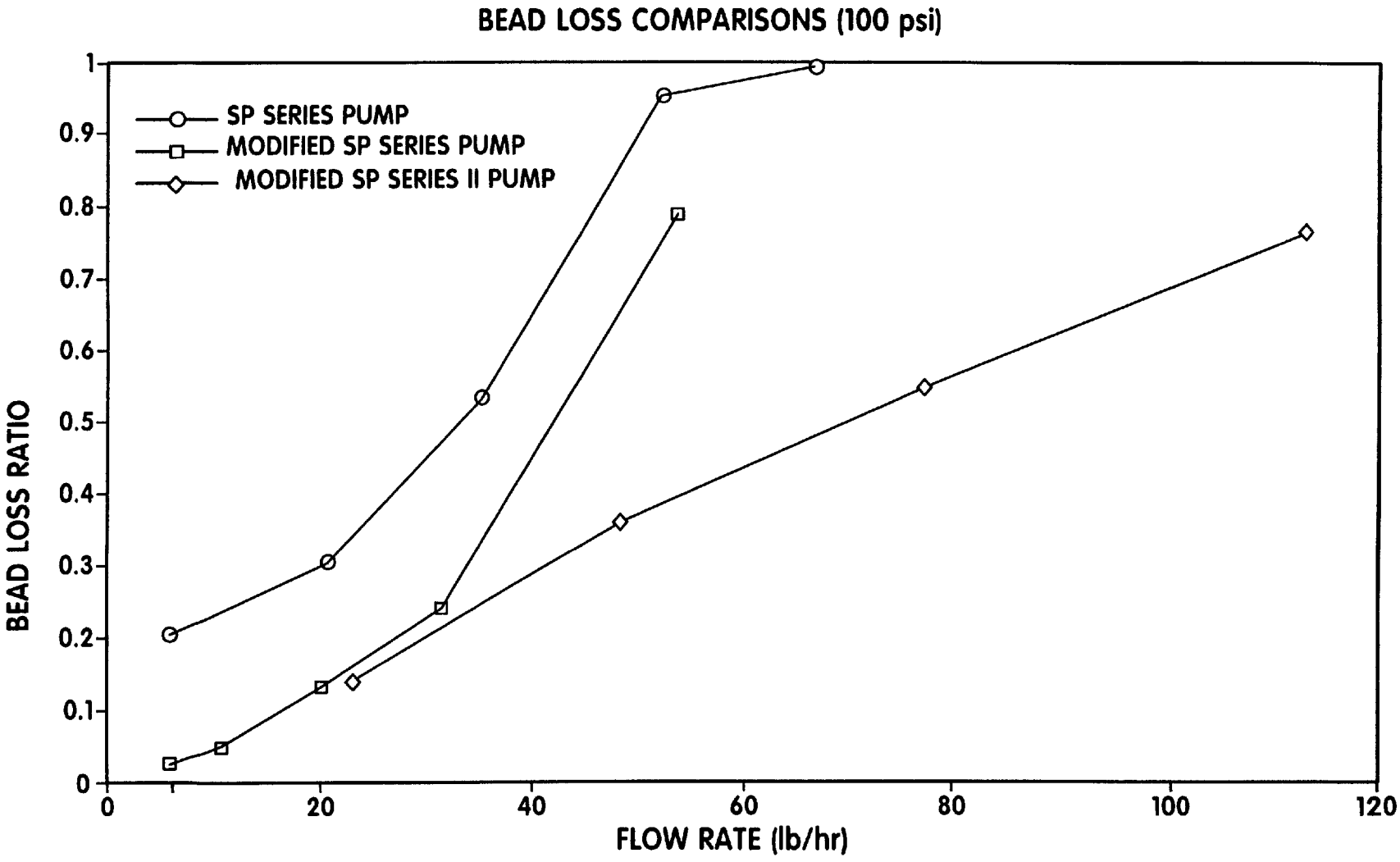
FIG. 5 is a graph illustrating bead loss comparisons of three different dual acting pumps operating at 100 psi liquid pressure.
Figure 6:
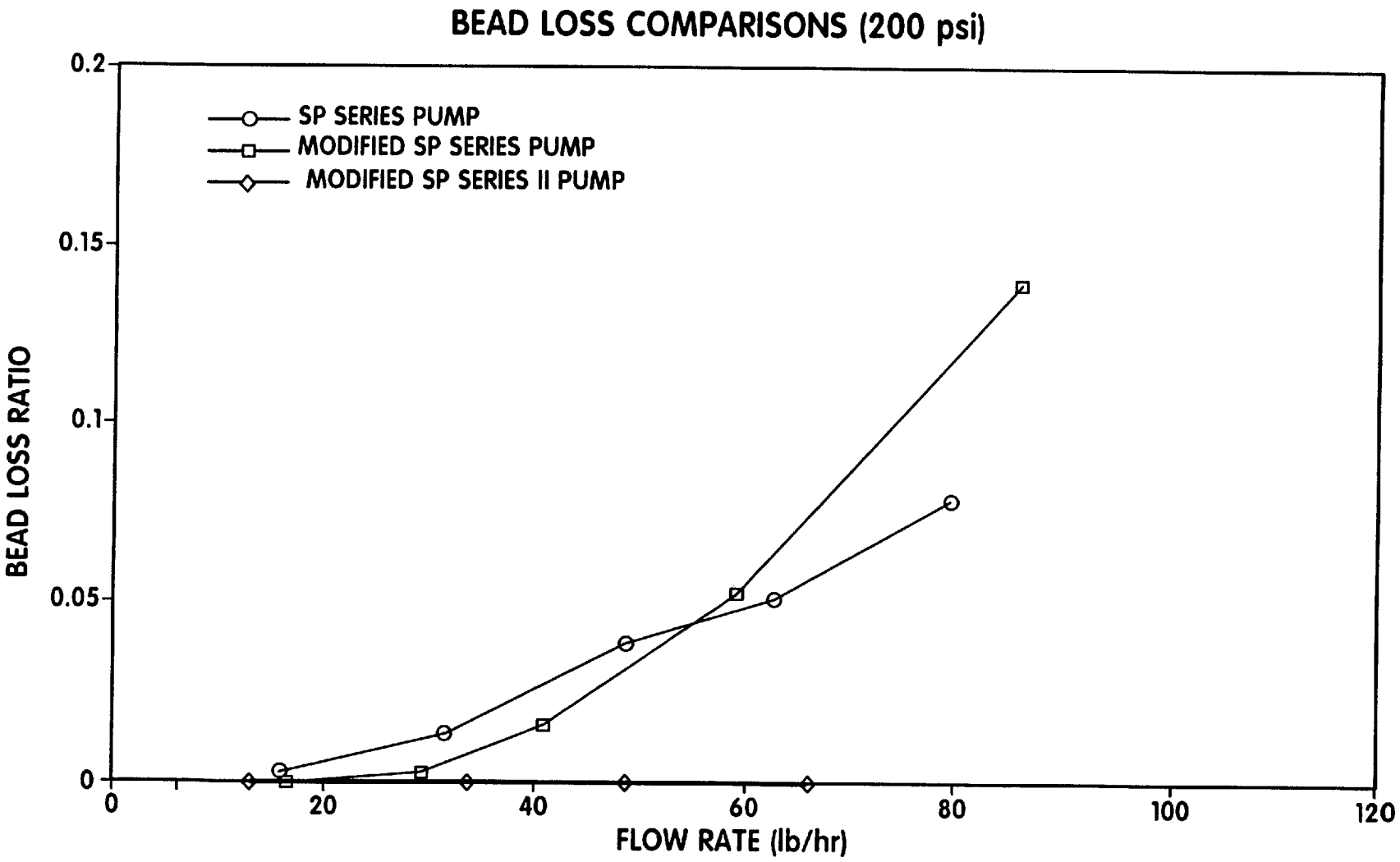
FIG. 6 is a graph similar to FIG. 5, but showing bead loss for the same pumps operating at 200 psi liquid pressure.

Another manner of defining bead loss on a per cycle basis is in the form of a ratio between the lost bead time during a pump cycle relative to the total time of the cycle. FIGS. 5 and 6 graphically compare bead loss ratios between three different pump configurations. These configurations include a Nordson SP Series pump as described above, a modified SP Series pump having spring-loaded, solid balls used as check valves in the pump shaft and at the pump inlet, and a further modified SP Series pump, labeled "Modified SP Series II Pump", and having spring-loaded, solid balls used as check valves in the pump shaft and pump inlet and a separate spring-loaded check valve connected at the pump outlet as described above. FIG. 5 compares bead loss, as a ratio, between the three different pump configurations at 100 psi liquid pressure, while FIG. 6 illustrates a similar comparison at 200 psi liquid pressure. In each case, the graphs show that bead loss is significantly less using pumps configured according to the invention. This is particularly evident at higher flow rates. At the higher liquid pressure of 200 psi illustrated in FIG. 6, bead loss is negligible across all the tested flow rates for the Modified SP Series II pump.

While the present invention has been illustrated by a description of the preferred embodiment and while this embodiment has been described in some detail, it is not the intention of the Applicant to restrict or in any way limit the scope of the appended claims to such detail. Additional advantages and modifications will readily appear to those skilled in the art. For example, various types of reciprocating pump configurations and spring-loaded check valve members may be substituted for those described specifically herein. This has been a description of the present invention, along with the preferred methods of practicing the present invention as currently known. However, the invention itself should only be defined by the appended claims, wherein I claim:

What is claimed is:

1. A pump for dispensing pressurized liquids, the pump comprising:

a pump housing having a liquid inlet passage and a liquid outlet passage;

a pumping chamber disposed in the housing and having first and second sections, the first section communicating with said liquid inlet passage and the second section communicating with the liquid outlet passage, a pump shaft having first and second ends with the second end including a flow passage and mounted for reciprocating movement in first and second opposed directions to alternately move the liquid from the first and second sections of said chamber to the liquid outlet passage during movement in the respective first and second directions, and a spring-biased flow passage check valve member including a hollow ball biased by a compression spring, said flow passage check valve member coupled to the flow passage for quickly closing the flow passage during movement in said first direction and for quickly opening the flow passage during movement in said second direction.

2. A pump for dispensing pressurized liquids, the pump comprising:

a pump housing having a liquid inlet passage and a liquid outlet passage;

a pumping chamber disposed in the housing and having first and second sections, the first section communicating with said liquid inlet passage and the second section communicating with the liquid outlet passage, a pump shaft having first and second ends with the second end including a flow passage and mounted for reciprocating movement in first and second opposed directions to alternately move the liquid from the first and second sections of said chamber to the liquid outlet passage during movement in the respective first and second directions, and a spring-biased inlet check valve member including a ball biased by a compression spring, said inlet check valve member coupled with the liquid inlet passage and operable to quickly close the liquid inlet passage as the pump shaft changes from the first direction of movement to the second direction of movement thereby reducing liquid back flow within the pump and providing adequate liquid output during the changes in direction.

3. The pump of claim 2, wherein said ball of said spring-biased inlet check valve member is hollow.

4. The pump of claim 2, further comprising:

a spring-biased flow passage check valve member including a ball biased by a compressed spring, the flow passage check valve member coupled to the flow passage for quickly closing the flow passage during movement in said first direction and for quickly opening the flow passage during movement in said second direction.

5. The pump of claim 4, wherein at least one of the balls of the outlet check valve member and inlet check valve member is hollow.

6. A pump for dispensing pressurized liquids, the pump comprising:

a pump housing having a liquid inlet passage and a liquid outlet passage;

a pumping chamber disposed in the housing and having first and second sections, the first section communicating with said liquid inlet passage and the second section communicating with the liquid outlet passage, a pump shaft having first and second ends with the second end including a flow passage and mounted for reciprocating movement in first and second opposed directions to alternately move the liquid from the first and second sections of said chamber to the liquid outlet passage during movement in the respective first and second directions, and a spring-biased outlet check valve member coupled with the liquid outlet passage and operable to quickly close the liquid outlet passage as the pump shaft changes between the first and second directions of movement, thereby reducing liquid back flow within the pump and providing adequate liquid output during the changes in direction.

7. The pump of claim 6, wherein said spring-biased outlet check valve member includes a hollow ball biased by a compression spring.

8. The pump of claim 6, further comprising:

a spring-biased flow passage check valve member coupled to the flow passage for quickly closing the flow passage during movement in said first direction and for quickly opening the flow passage during movement in said second direction.

9. The pump of claim 8, wherein at least one of the outlet check valve member and flow passage check valve member includes a hollow ball biased by a compressed spring.

10. The pump of claim 6, further comprising:

a spring-biased inlet check valve member coupled to the liquid inlet passage and operable to quickly close the liquid inlet passage as the pump shaft changes from the first direction of movement to the second direction of movement.

11. The pump of claim 10, wherein at least one of the outlet check valve member and inlet check valve member includes a hollow ball biased by a compressed spring.

12. The pump of claim 10, further comprising:

a spring-biased flow passage check valve member coupled to the flow passage for quickly closing the flow passage during movement in said first direction and for quickly opening the flow passage during movement in said second direction.

13. The pump of claim 12, wherein at least one of the outlet check valve member, flow passage check valve member, and inlet check valve member includes a hollow ball biased by a compressed spring.

14. A method of preventing back flow in a pump and thereby providing more constant liquid output from the pump, wherein the pump includes an inlet, an outlet, a pumping chamber communicating between the inlet and the outlet, a reciprocating pump shaft disposed for movement in opposite directions in the pumping chamber, and at least one check valve member including a hollow ball connected in a liquid flow path defined between the inlet and the outlet, the method comprising:

moving the pump shaft in a first direction to draw liquid into the inlet and simultaneously discharge liquid from the outlet, changing the direction of movement of said pump shaft, closing the check valve member using a spring bias on the hollow ball during the change in direction of movement of said pump shaft, and moving the pump shaft in a second direction to discharge additional liquid from the outlet.

15. The method of claim 14, wherein the check valve member is carried by the pump shaft and the step of moving the pump shaft in the second direction includes forcing liquid past the check valve member.

16. The method of claim 14, wherein the check valve member is connected with the pump inlet and the step of moving the pump shaft to draw liquid into the inlet further includes drawing liquid past the check valve member.

17. The method of claim 14, wherein the check valve member is connected with the pump outlet and the steps of moving the pump shaft to discharge liquid from the outlet further include discharging the liquid past the check valve member.

18. The method of claim 14, wherein an inlet check valve member is connected to the inlet, a flow passage check valve member is connected to the pump shaft, and an outlet check valve member is connected to the outlet, wherein moving the pump shaft in the first direction includes forcing the flow passage check valve member closed and forcing the inlet and outlet check valve members open to draw liquid into the inlet and simultaneously discharge liquid from the outlet, and wherein moving the pump shaft in the second direction includes forcing the flow passage check valve member and outlet check valve member open and forcing the inlet check valve member closed to discharge additional liquid from the outlet.

19. A method of preventing back flow in a pump and thereby providing more constant liquid output from the pump, wherein the pump includes an inlet, an outlet, a pumping chamber communicating between the inlet and the outlet, a reciprocating pump shaft disposed for movement in opposite directions in the pumping chamber, and a spring-biased outlet check valve member connected with the pump outlet, the method comprising:

moving the pump shaft in a first direction to draw liquid into the inlet and simultaneously discharge liquid from the outlet past the outlet check valve member, changing the direction of movement of said pump shaft, closing the outlet check valve member using a spring bias during the change in direction of movement of said pump shaft, moving the pump shaft in a second direction to discharge additional liquid from the outlet past the outlet check valve member, changing the direction of movement of said pump shaft, and closing the outlet check valve member using the spring bias during the change in direction of movement of said pump shaft.

20. The method of claim 19, wherein the pump further includes a spring-biased inlet check valve member connected to the inlet and a spring-biased flow passage check valve member connected to the pump shaft, wherein moving the pump shaft in the first direction includes forcing closed the flow passage check valve and forcing open the inlet check valve member, and wherein moving the pump shaft in the second direction includes forcing open the flow passage check valve member and forcing closed the inlet check valve member, and the method further comprising:

closing the inlet check valve member using the spring bias during each change in direction of movement of said pump shaft, and closing the flow passage check valve member using the spring bias during each change in direction of movement of said pump shaft.

* * * * *